US006900164B2

(12) United States Patent
Ajmani et al.

(10) Patent No.: US 6,900,164 B2
(45) Date of Patent: May 31, 2005

(54) BINARY FOAMING DRAIN CLEANER

(75) Inventors: Inderjeet K. Ajmani, Fremont, CA (US); Jessica Y. Chung, San Jose, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 10/442,286

(22) Filed: May 19, 2003

(65) Prior Publication Data

US 2003/0199411 A1 Oct. 23, 2003

Related U.S. Application Data

(63) Continuation of application No. 09/732,949, filed on Dec. 8, 2000, now Pat. No. 6,660,702.

(51) Int. Cl.[7] ..... C11D 1/75; C11D 3/39; C11D 3/395

(52) U.S. Cl. ..... 510/195; 510/191; 510/199; 510/372; 510/379; 510/380; 510/381

(58) Field of Search ..... 510/191, 195, 510/199, 372, 379, 380, 381

(56) References Cited

U.S. PATENT DOCUMENTS 6,479,444 B1 * 11/2002 Porticos et al. ..... 510/195
6,638,900 B2 * 10/2003 Ajmani et al. ..... 510/372
6,660,702 B2 * 12/2003 Ajmani et al. ..... 510/195

FOREIGN PATENT DOCUMENTS

| | | | |
|---|---|---|---|
| JP | 60-13897 | * | 1/1985 |
| WO | WO98/33880 | * | 8/1998 |
| WO | WO00/12672 | * | 3/2000 |

* cited by examiner

*Primary Examiner*—Gregory R. Del Cotto
(74) *Attorney, Agent, or Firm*—Monica H. Winghart

(57) ABSTRACT

A composition is provided comprising two liquids which are separately maintained prior to forming an admixture during delivery to a surface to be treated, whereupon the admixture generates a foam sufficient for cleaning efficacy and stability. A first liquid preferably includes a hypohalite, or a hypohalite generating agent and a second liquid preferably includes a peroxygen agent. The first liquid is thickened to a specified rheology, resulting in the generation of a highly effective foam. As the two liquids are initially separated, the hypohalite generating agent can be maintained in an environment free of peroxygen agent and otherwise conducive to their cleaning activity and stability up to the time of use. When the two liquids are allowed to mix, for example, by simultaneously pouring into a drain, the hypohalite and peroxygen react to liberate oxygen gas. As foam generation occurs, the escaping gas contacts surfactant in the solution, and creates foam which expands to completely fill the drain pipe. The expanded foam contains an excess of the hypohalite, which acts to clean the drain.

14 Claims, No Drawings

BINARY FOAMING DRAIN CLEANER

RELATED APPLICATIONS

This application is a continuation of concurrently pending U.S. patent application Ser. No. 09/732,949 to Ajmani et al. and filed Dec. 8, 2000 now U.S. Pat. No. 6,660,702.

BACKGROUND OF THE INVENTION

1. Field of the Invention

The present invention relates to foaming cleaning compositions, and in particular to an in situ foaming cleaning composition incorporating a bleach and which is formulated to have utility as a drain cleaner, or as a hard surface cleaner.

2. Description of Related Art

Published Japanese applications to Ishimatsu et al JP 59-24798 and JP 60-32497; JP 59-164399, to Miyano et al; and Sakuma, JP 57-74379 all disclose, describe and claim a binary foaming cleaner having utility as a drain opener. Miyano et al specifically describes the advantages of a foam in drain opening. Ishimatsu_et al and Miyano et al both describe an aqueous peroxide solution containing 0.25–25% active, paired with an aqueous solution of 0.25–6% hypochlorite, and both references teach the inclusion of surfactants with either or both solutions to enhance foaming. None of these references, however, teach, suggest or disclose a thickened formulation, nor any of the advantages and foam characteristics associated therewith.

A hypochlorite composition paired with a chelating agent/builder solution in a dual chamber container is disclosed in U.S. Pat. No. 5,767,055 to Choy et al.

Drain cleaners of the art have been formulated with a variety of actives in an effort to remove the variety of materials which can cause clogging or restriction of drains. Such actives may include acids, bases, enzymes, solvents, reducing agents, oxidants and thioorganic compounds. Tobiason, U.S. Pat. No. 5,264,146, Steer, et al, U.S. Pat. No. 5,630,833 and Taylor, Jr. et al., U.S. Pat. No. 4,664,836 all disclose dry compounds which generate foam when mixed with water in a drain. Kuenn, U.S. Pat. No. 4,691,710 describes a dry in-sink garbage disposal cleaning composition which uses adipic acid and sodium bicarbonate to generate gas upon contact with water. This composition requires mechanical shearing from the disposal to assist in foam generation. Davis, U.S. Pat. No. 4,206,068 describes an exothermic drain opening composition comprising an oxidant and a reducing agent in a compartmentalized container.

SUMMARY OF THE PRESENT INVENTION

In view of the prior art, there remains a need for a foam generating cleaning composition capable of delivering a high percentage of active and possessing a long contact time on non-horizontal surfaces. There further remains a need for an in-situ foam-generating composition which is stable during storage and can be economically formulated.

It is another object of the present invention to provide a composition capable of forming an active-carrying foam in situ.

It is another object of the present invention to provide a composition capable of generating a stable foaming active cleaner.

It is another object of the present invention to provide a dual component composition and containment means which isolates each component during storage.

It is another object to provide a drain opening composition which is formulated to be safe to store and use.

It is another object of the present invention to provide a foaming cleaning composition having utility as a drain cleaner by virtue of its rheology.

It is yet another object of the present invention to provide a drain cleaning composition which is highly effective.

It is yet another object of the present invention to provide a composition having beneficial flow properties during dispensing.

More specifically, the composition is a product of two liquids which are separately maintained prior to forming an admixture during delivery to a surface to be treated, whereupon the admixture generates a foam sufficient for cleaning efficacy and stability. A first liquid includes an oxidant, preferably a hypohalite or a hypohalite generating agent (hereinafter "hypohalite") and a second liquid includes a gas generating agent, preferably a peroxygen containing or releasing agent. As the two liquids are initially separated, the oxidant can be maintained in an environment free of gas generating agent and otherwise conducive to their cleaning activity and stability up to the time of use. When the two liquids are allowed to mix, for example, by simultaneously pouring into a drain, the hypohalite and peroxygen react to liberate oxygen gas in accordance with the following reaction equation:

$$NaOCl+H_2O_2 \rightarrow O_2(g)+NaCl+H_2O$$

The liberated gas contacts surfactant in the solution, creating foam which expands to completely fill the drain pipe. The expanded foam contains an excess of the hypohalite, which acts to clean the drain. The resulting foam is stable, and preferably characterized by a density of greater than about 0.1 g/ml, a half life of greater than about thirty minutes; and an initial foam development rate of at least 150 ml/sec for the first 2–4 sec. Foam stability is defined as the foam's resistance to a force tending to collapse or displace the foam. The foam is further characterized by a ratio of foam:liquid of at least 1:1, preferably 2:1, more preferably 3:1; and a foam height sufficient to yield a greater than twelve cm. column in the drain (as measured from the center, or lowest point of the P-trap, and for a 3.2 cm. diameter drain), more preferably greater than seventeen cm. and most preferably seventeen to thirty-one cm. Most preferred in terms of foam volume and height in the drain, is an amount sufficient to reach the drain's stopper mechanism, a site of frequent hair and/or soap contamination. Such stopper mechanisms are typically positioned about twenty cm. up the vertical pipe. The foam would preferably contain greater than 0.1% active, more preferably greater than 0.5% active, and most preferably between about 0.75 and 3% active. An active contact time, or foam half life, should be between one-half and two hours, preferably between one and two hours. Foam half-life is the time elapsed between maximum foam volume development and a 50% volume reduction thereof, absent any external forces (other than gravity) acting upon the foam. Further, the foam is self-generating, produced by reaction of composition components, and requires no mechanical agitation or other forms of physical activation.

In a one embodiment of the present invention, the first liquid (oxidant) includes a thickening agent or system, present in an amount such that when the first and second liquids form an admixture during delivery to a surface, the admixture results in a dense, stable foam sufficient for cleaning efficacy and stability. Thus, when the initially separated liquids are allowed to interact, the resulting liquid cleaning composition being delivered to the surface will have the cleaning or bleaching activity and stability appropriate for the cleaning or bleaching of that surface. The term "liquid" as used herein may include homogeneous liquids, solutions and suspensions. Preferably an aqueous liquid is contemplated; however, nonaqueous liquids are within the scope of the invention. The thickening agent or system should impart both a viscous component and an elastic component to the corresponding liquid. Most preferably the thickening agent or system imparts a viscoelastic rheology to the corresponding liquid; however, the composition of the thickening system is less important than the attainment of the desired foam qualities as defined herein.

The present invention also relates to a container which maintains the two liquids separately until delivery and provides for such delivery, during which the pH-maintained admixture is formed and delivered to a surface to be treated. The container includes one compartment for the hypohalite containing liquid and another compartment for the peroxygen-containing liquid. Either or both of these two compartments may contain the thickening system or agent which, is present in an amount sufficient to thicken and for stability of the liquid, as described above. According to one aspect of the invention, the container may have separate delivery channels for the two liquid components for delivering the two liquids, whereupon the admixture is formed. These delivery channels may be constructed to provide for the contemporaneous delivery of the two liquids to the exterior of the container, whereupon the two liquids meet to form the admixture. Alternately, the separate delivery channels may communicate with an admixing space in which the two liquids form the admixture and from which the admixture is delivered to the exterior of the container. One example of such a container is that disclosed in U.S. Pat. No. 5,767,055 Choy et al., the disclosure of which is incorporated fully herein by reference.

The present invention further includes a method of cleaning drains which comprises the step of:

pouring into a drain at least one liquid which generates foam in situ, the foam characterized by a volume of at least two times the liquid volume; a density of at least about 0.1 g/ml, a half-life of greater than about thirty minutes, and wherein the foam contains a cleaning-effective amount of a drain cleaning active. It is also within the scope of the present invention to provide a single solution capable of generating the foam upon release from its container, as by pouring into the drain.

Briefly, a first embodiment of the present invention comprises a stable cleaning composition comprising, in aqueous solution:

(a) a first liquid containing an oxidizing agent; and (b) a second liquid containing a gas generating agent; and wherein the oxidizing agent and gas generating agent react to generate a foam characterized by a density of at least about 0.1 g/ml, a volume of at least two times the liquid volume, a half-life of greater than about thirty minutes, and wherein the foam contains a cleaning-effective amount of a drain cleaning active.

It should be noted that as used herein the term "cleaning" refers generally to a chemical, physical or enzymatic treatment resulting in the reduction or removal of unwanted material, and "cleaning composition" specifically includes drain openers, hard surface cleaners and bleaching compositions. The cleaning composition may consist of a variety of chemically, physically or enzymatically reactive active ingredients, including solvents, acids, bases, oxidants, reducing agents, enzymes, detergents and thioorganic compounds. Unless otherwise specified, all ingredient percentages are weight percentages.

For purposes of the discussion of the invention disclosed herein, a typical household sink drain comprises four sections: a vertical section, thence to a U-bend (or P-trap), thence to a 90-degree elbow, and finally a horizontal sewer arm.

A viscous rheology, preferably one with an elastic component, most preferably a viscoelastic rheology, is imparted to the oxidant liquid, preferably by a binary system including a betaine or sulfobetaine having a $C_{14-18}$ alkyl group, or a $C_{10-18}$ alkylamino or alkylamido group, and an anionic organic counterion that is thought to promote elongated micelles. Such systems are more fully described in U.S. Pat. Nos. 4,900,467 and 5,389,157 to Smith, and assigned to the assignee of the invention herein, the disclosures of which are incorporated herein by reference. Preferably the betaine is a $C_{14-18}$ alkyl betaine and the counterion is a $C_{2-6}$ alkyl carboxylate, aryl carboxylate, $C_{2-10}$ alkyl sulfonate, aryl sulfonate, sulfated aryl or $C_{2-10}$ alkyl alcohols, and mixtures thereof. Most preferably the counterion is an aryl sulfonate, e.g. sodium xylene sulfonate. The counterion may include substituents which are chemically stable with the active cleaning compound. Preferably, the substituents are alkyl or alkoxy groups of 1–4 carbons, halogens and nitro groups, all of which are stable with most actives, including hypochlorite. The viscosity of the formulations of the present invention can range from slightly greater than that of water, to several thousand centipoise (cP). A preferred viscosity range for the first (oxidant-containing) liquid is about 150 to 2000 cP, more preferred is 500 to 2000 cP most preferred is 700–1500 cP. A preferred viscosity for the second (gas generating) liquid is about 0–50 cP, more preferred is 0–20 cP.

A second embodiment of the present invention is a composition and method for cleaning drains, the composition comprising separately maintained aqueous solutions of:

(a) a first liquid including a hypohalite compound and having a viscosity of 150–2000 cP, a static shear modulus of 0.5–5 Pa, a relaxation time of 3–30 sec and a relative elasticity of 3–50 sec/Pa; and;

(b) a second liquid comprising a peroxygen compound.

The liquids (a) and (b) are maintained separately during storage, and combined concurrently with, or immediately prior to use. Preferably, the liquids (a) and (b) are maintained in a dual chamber or compartment bottle, and poured simultaneously into the drain wherein the foam generation occurs. The resulting foam is stable and dense, and contains a high percentage of cleaning active, especially hypohalite, which coats the vertical and upper P-trap portions of a drain. The rheology of each composition provides a favorable rate of foam generation and residence time, resulting in excellent cleaning efficacy. The rate of foam generation should be initially (at initiation of the reaction to about 4–6 sec thereafter) about 150–800 ml/sec, and should be about 3–40 ml/sec after about 15–30 sec. The foam should remain stable for an extended period of time, i.e. at least thirty minutes. The rheology also facilitates filling of the container, e.g., during manufacturing, and affords consumer-acceptable, smooth pouring properties during dispensing and use. The preferred viscoelastic rheology may be imparted by a thickener, preferably a surfactant thickener.

It is therefore an advantage of the present invention that the composition is chemically and phase-stable, and retains such stability at both high and low temperatures.

It is another advantage of the present invention that, when formulated as a drain cleaner the foaming composition provides a long contact time, improving the efficacy of the cleaner.

It is another advantage of the present invention that the improved efficacy resulting from the increased contact time allows for safer drain cleaning formulations.

It is yet another advantage of the present invention that the composition generates a stable, active-containing foam in-situ.

It is a further advantage of the composition of the present invention that the rheology of the composition facilitates container filling, and dispensing.

These and other objects and advantages of the present invention will no doubt become apparent to those skilled in the art after reading the following Detailed Description of the Preferred Embodiments.

DETAILED DESCRIPTION OF THE PREFERRED EMBODIMENTS

Oxidizing Agent

The oxidizing agent, or oxidant, may preferably be selected from various hypohalite-producing species, for example, halogen bleaches selected from the group consisting of the alkali metal and alkaline earth salts of hypohalite, halo amines, haloimines, haloimides and haloamides. All of these are believed to produce hypohalous bleaching species in situ. Preferably, the first oxidizing agent is a hypohalite or a hypohalite generator capable of generating hypohalous bleaching species. As used herein, the term "hypohalite" is used to describe both a hypohalite or a hypohalite generator, unless otherwise indicated. Hypochlorite and compounds producing hypochlorite in aqueous solution are preferred, although hypobromite is also suitable. Representative hypochlorite-producing compounds include sodium, potassium, lithium and calcium hypochlorite, chlorinated trisodium phosphate dodecahydrate, potassium and sodium dicholoroisocyanurate and trichlorocyanuric acid. Organic bleach sources suitable for use include heterocyclic N-bromo and N-chloro imides such as trichlorocyanuric and tribromo-cyanuric acid, dibromo- and dichlorocyanuric acid, and potassium and sodium salts thereof, N-brominated and N-chlorinated succinimide, malonimide, phthalimide and naphthalimide.

Also suitable are hydantoins, such as dibromo and dichloro dimethyl-hydantoin, chlorobromodimethyl hydantoin, N-chlorosulfamide (haloamide) and chloramine (haloamine). Particularly preferred in this invention is sodium hypochlorite having the chemical formula NaOCl, in an amount ranging from about 0.1 weight percent to about 15 weight percent of the first liquid, more preferably about 0.1 to 10 weight percent, and most preferably about 1 to 8 weight percent. The oxidizing agent may be present in an stoichiometric amount to the gas generating agent for the generation of foam. If so, it is preferred that a separate cleaning active be included with either or both the first and second liquids. More preferred is that the oxidizing agent be present in a stoichiometric excess, to both generate foam and provide cleaning and drain opening activity.

Gas Generating Agent

The gas generating agent is a compound which can react with the oxidizing agent to generate a gas and is preferably a peroxide or peroxide-generator, such as hydrogen peroxide, or a peracid or persalt, including both organic and inorganic peracids and persalts, such as peracetic acid and monoperoxysulfate, respectively. A number of peroxides, peracids and persalts are disclosed in U.S. Pat. No. 4,964,870, to Fong, et al, the disclosure of which is incorporated herein in its entirety by reference. Hydrogen peroxide is normally supplied as a liquid, although other hydrogen peroxide sources may also function satisfactorily. For example, perborate and percarbonate also supply $H_2O_2$ in solution. The gas generating agent is present in an amount of about 0.01 to 8 weight percent of the second liquid, preferably about 0.1 to 5 weight percent, most preferably about 0.2 to 3 weight percent.

Where peroxide is the gas generating agent and a hypohalite is the oxidizing agent, a preferred weight ratio (to provide a stoichiometric excess) of hypohalite to peroxide is about 20:1 to 3:1, more preferred is about 15:1 to 5:1, and most preferred is 12:1 to 7.1. A preferred mole ratio (to provide a stoichiometric excess) of hypohalite to peroxide is about 10:1 to 1:1, more preferred is about 7:1 to 5:4, and most preferred is about 6:1 to 2:1.

Electrolyte/Buffer

An electrolyte/buffer may be included with either the first or second liquids and preferably is included in the first, oxidant-containing liquid in a buffering-effective amount.

According to the present invention, suitable electrolytes/buffers may be selected from the group consisting of a carbonate, a phosphate, a pyrophosphate, an amino carboxylate, a polycarboxylate, a polyacrylate, a phosphonate, an amino phosphonate, a polyphosphonate, a salt thereof, and a mixture thereof. The electrolyte/buffer is present in an amount ranging from 0 to about 5 weight percent of the first liquid, preferably from about 0.01 to about 4 weight percent of the first liquid.

pH-Adjusting Agents

A pH-adjusting agent may be present in either one or both of the two liquids, i.e., with the oxidant and/or gas generating agent. According to the present invention, the pH-adjusting agent maintains the pH of the liquid such that the active agent therein is stable and efficacious. The pH adjusting agent can be either alkaline or acidic in solution, and correspondingly serve to adjust and/or maintain either solution to an alkaline or acidic pH. In the present invention, each solution is maintained at a pH appropriate for the activity and stability of the oxidizing or gas generating agent and/or cleaning active therein. For an alkaline oxidizing agent, such as a hypohalite, the solution pH is alkaline. When the gas generating agent is peroxygen, the pH is acidic. The pH-adjusting agent may be present in a pH adjusting effective amount, such as between about 0 and about 10 weight percent of one of the liquids.

Suitable acidic pH adjusting agents include: organic acids, especially carboxylic acids such as citric, glycolic, or acetic acids, weak inorganic acids such as boric acid or sodium bisulfate, and dilute solutions of strong inorganic acids such as sulfuric acid, hydrochloric acid, pyrophosphates, triphosphates, tetraphosphates, silicates, metasilicates, polysilicates and borates and mixture of the foregoing. When the gas-generating agent is peroxide, a preferred acidic pH adjusting agent is sulfuric acid. For a peroxygen-containing liquid, especially hydrogen peroxide, it is preferred the pH be maintained below about 7, more preferably between 3 and 6 to maintain stability and efficacy of the peroxygen compound. An acidic pH-adjusting agent is present in an amount of from 0 to 5 weight percent to the second liquid, preferably from 0.001 to 2 weight percent.

Preferred alkaline pH adjusting agents include: carbonates, bicarbonates, hydroxides, hydroxide generators and mixtures of same. When the oxidant is a hypohalite, a preferred alkaline pH-adjusting agent is an alkali metal hydroxide, especially sodium hydroxide. For example, when a hypohalite oxidizing agent is used, the pH of the solution is preferably maintained at above about 10, preferably above about 10.5, and more preferably above about 11. An solution pH of above about 11 is believed to be sufficient for both the cleaning efficacy and the stability of hypohalite. More particularly, this solution pH is believed to be sufficient to protect against the autocatalytic destruction of the hypohalite that might otherwise occur when the solution is formed. An alkaline pH-adjusting agent is present in an amount of from 0 to 20 weight percent, to the first liquid, preferably from 0.1 to 15 weight percent.

Thickener

The first oxidant solution or liquid is thickened, preferably with a surfactant thickener. Suitable thickeners are as described in previously referenced Smith patents. Other suitable systems may be found in the disclosures of U.S. Pat. No. 5,055,219 and U.S. Pat. No. 5,011,538 to Smith; U.S. Pat. No. 5,462,689 and U.S. Pat. No. 5,728,665 to Choy, et al., all commonly owned with the invention herein, and the disclosures of each of which are incorporated fully herein by reference. Additional thickeners such as polymers and gums are suitable as long as the desired foam characteristics and/or rheology is attained. Most preferred is a binary surfactant viscoelastic thickener comprising a betaine and anionic counterion.

Betaine

Operative betaines include the $C_{14-18}$ alkyl betaines and $C_{14-18}$ alkyl sulfobetaines. Especially preferred is a cetyl dimethyl betaine (CEDB) such as Amphosol CDB (a trademarked product of the Stepan Company), which is about 95% or greater $C_{16}$, less than 5% $C_{12/14}$ and less than 1% $C_{18}$. It is noted that when referring to carbon chain lengths of the betaine or any other compound herein, the commercial, polydisperse forms are contemplated (but not required). Thus, a given chain length within the preferred $C_{14-18}$ range will be predominately, but not exclusively, the specified length. As used herein in reference to the betaine or sulfobetaine, the term "alkyl" includes both saturated and unsaturated groups. Fully saturated alkyl groups are preferred in the presence of hypochlorite. $C_{10-18}$ alkylamido and alkylamino betaines, and sulfobetaines having $C_{14-18}$ alkyl, or $C_{10-18}$ alkylamino or alkylamido groups, are also suitable for use in the compositions of the present invention.

The betaine is added at levels, which, when combined with the counterion, are thickening effective. Generally about 0.01 to 5 weight percent of the betaine is utilized per each of the first and/or second liquid, preferred is to use about 0.1 to 3% betaine, and most preferred is about 0.5–2.0 percent betaine.

Counterion

The counterion is an anionic organic counterion selected from the group consisting of $C_{2-6}$ alkyl carboxylates, aryl carboxylates, $C_{2-10}$ alkyl sulfonates, aryl sulfonates, sulfated $C_{2-10}$ alkyl alcohols, sulfated aryl alcohols, and mixtures thereof. The aryl compounds are derived from benzene or napthalene and may be substituted or not. The alkyls may be branched or straight chain, and preferred are those having two to eight carbon atoms. The counterions may be added in acid form and converted to the anionic form in situ, or may be added in anionic form. Suitable substituents for the alkyls or aryls are $C_{1-4}$ alkyl or alkoxy groups, halogens, nitro groups, and mixtures thereof. Substituents such as hydroxy or amine groups are suitable for use with some non-hypochlorite cleaning actives, such as solvents, surfactants and enzymes. If present, a substituent may be in any position on the rings. If benzene is used, the para (4) and meta (3) positions are preferred. In some circumstances the cleaning active itself may be within the class of thickening-effective counterions. For example, some carboxylic acid cleaning actives may be present in both the acid and conjugate base forms, the latter which could serve as the counterion. The $C_{2-6}$ alkyl carboxylates may act in this manner. The counterion is added in an amount sufficient to thicken and result in a viscoelastic rheology, and preferably between about 0.01 to 10 weight percent. A preferred mole ratio of betaine to counterion depends on the chain length and concentration of the betaine, type of counterion, and the ionic strength of the solution, as well as whether the primary object of the composition is phase stability or viscosity. Using CEDB and sodium xylene sulfonate (SXS), a preferred mole ratio is about 10:1 to 1:3, and more preferred is about 2:1 to 1:2. A preferred weight ratio of CEDB to SXS is about 3:1 to 1:1, and more preferred is 2:1 to 5:4.

The viscoelasticity of the thickener advantageously imparts unusual flow properties to the cleaning composition. Elasticity causes the stream to break apart and snap back into the bottle at the end of pouring instead of forming syrupy streamers. Further, elastic fluids appear more viscous than their viscosity indicates. The viscoelastic properties of a fluid can be measured with instruments such as a Bohlin VOR rheometer. A frequency sweep with a Bohlin rheometer can produce oscillation data which, when applied to a Maxwell model, result in parameters such as relaxation time (Tau) and static shear modulus (G0). The relaxation times of the oxidant containing formulations of the present invention are between about 3–30 seconds, preferably between about 4–20 seconds more preferably between about 5–15 seconds and most preferably between about 6–12 seconds. The static shear modulus (G0) should be between about 0.5–5 Pa, preferably 0.7–3 Pa more preferably 1–2 Pa. The ratio of relaxation time to static shear modulus (Tau/G0), previously defined as relative elasticity by Smith, may be between about 3–50 sec/Pascal (Pa,); alternatively between about 4–40 sec/Pa., or 5–25 sec/Pa, or 6–12 sec./Pa. While the thickeners described herein are effective to develop viscoelasticity over a range of solution ionic strengths, the ionic strength does influence rheology to some extent. Accordingly, unless otherwise stated, the relaxation times relative elasticities and viscosity values used herein are calculated for a first (hypohalite-containing) liquid having an ionic strength of about 2.4 molal.

Adjuncts

A number of classes of adjunct compounds are known and are compatible with the first and second liquids and components thereof. One such class are adjunct cleaning actives, which interact with their intended target materials either by chemical or enzymatic reaction or by physical interactions, hereinafter collectively referred to as reactions. It is noted that either the oxidant or gas generating agent can function as the cleaning active, particularly when one is present in a stoichiometric excess over the other. Preferably, the oxidant is present in a stoichiometric excess over the gas generating agent; however, a cleaning active may be additionally included. Useful active compounds thus include acids, bases, oxidants, reductants, solvents, enzymes, thioorganic compounds, surfactants (detergents) and mixtures thereof. Examples of enzymes include lipases, keratinases, proteases, amylases, and cellulases. Useful solvents include saturated hydrocarbons, ketones, carboxylic acid esters, terpenes, glycol ethers, and the like. Thioorganic compounds such as sodium thioglycolate can be included to help break down hair and other proteins. Various nonionic, anionic, cationic or amphoteric surfactants can be included, as known in the art, for their detergent properties. Examples include taurates, sarcosinates and phosphate esters. Other noncleaning active adjuncts as known in the art, such as corrosion inhibitors, dyes and fragrances, may also be included.

While compositions containing an oxidant liquid having a viscous rheology, especially a viscoelastic rheology, provide a benefit when applied to drains having porous or partial clogs (defined as one which causes the flow to diminish, but not to stop), the full benefit is obtained when the composition also possesses a density greater than water. This density may be attained without the need for a densifying material, however, when necessary to increase the density, a salt such as sodium chloride is preferred and may be added at levels of 0 to about 25 weight percent to the liquid, preferably 12–25 weight percent. With a porous or partial clog, foam generation occurs principally at the interface of the two liquids in the sink, and secondarily within the P-trap, permitting the foam to expand both upwards from the P-trap and downwards from the sink to contact fully the clogged portions of the drain, especially the vertical pipe. The expanding gas passes through the oxidant, entraining it into the foam and distributing it throughout the pipe. The rheology of the oxidant-containing first liquid specifically controls foam generation by promoting rapid mixing with the second solution providing a fast and complete foaming reaction. It is most preferred the first liquid have a specific gravity of about 1.15–1.05, and the second liquid have a specific gravity less than that of the first, more preferably about 1.10 to 1.00.

The following table (Table I) illustrates the important rheological characteristics of the hypochlorite and peroxide components.

TABLE I

| Formula | Viscosity (cP) | Relative Elasticity (sec/Pa) | Relaxation Time (sec.) |
|---|---|---|---|
| hypochlorite (a) | 1072 | 1.27 | 10.03 |
| peroxide (b) | 8 | 0 | 0 |

(a) = 5.80% sodium hypochlorite, 1.85% sodium hydroxide, 0.0578% sodium carbonate, 0.1128% sodium silicate, 1.2% surfactant.
(b) = 0.68% hydrogen peroxide, 7% sodium chloride.

Viscosities were measured on a Brookfield Rheometer, model DV-II+, with a teflon□-coated number 2 spindle at 5 rpm after two minutes. Tau, G0 and relaxation times were measured on a Bohlin VOR at 25□C in the oscillatory mode.

The foam volume data of Table II (below) was measured by pouring about 500 ml of a composition according to Example (a) above, into a 2 L graduated cylinder. Foam volume was visually measured at various intervals. An initial phase (or phase I) of foam generation begins when the first and second liquids are combined, for example in a drain or on a surface, at time zero ($t_0$). The initial phase generally lasts about 1–10 seconds, preferably 4–6 seconds, from to and is defined by the highest rate of foam generation, about 150–800 ml/sec, preferably 200–500 ml/sec. Thereafter a secondary phase (or phase II) begins at the end of the initial phase and lasts for about an additional 100–1800 seconds, and is defined by a slower rate of foam generation varying from about 150 ml/sec to 0 ml/sec. After 15–25 seconds from $t_0$ the rate of foam generation is about 3–40 ml/sec., preferably 5–15 ml/sec.

TABLE II

| Foam Development | |
|---|---|
| Foam Development Time (sec) | Foam Volume (ml) |
| 1 | 200 |
| 3 | 400 |
| 5 | 800 |
| 6 | 1400 |
| 11 | 1600 |
| 25 | 1800 |
| 39 | 1900 |
| 65 | 2000 |
| 127 | 2100 |
| 350 | 2100 |
| 1500 | 2100 |

Table III below gives preferred viscosity, relative elasticity and relaxation time ranges for each of the preferred oxidizing agent and gas generating agent.

TABLE III

| | Oxidizing Agent | Gas Generating Agent |
|---|---|---|
| Viscosity (cPs.) | 150–2000 | 0–20 |
| Relative elasticity (Tau/G0) | 3–50 | 0 |
| Relaxation time (sec.) | 3–30 | 0 |

Table IV shows the effectiveness of the present invention at maintaining foam (containing actives) within the P-trap, vertical pipe and stopper where clog material reside. Foam loss occurs when foam siphons out the sewer arm. It has been found that the rheology of the formulation is important to prevent such loss of foam and concomitant loss of actives. In a system where the relative elasticity of the liquid is greater than about 50 sec/Pa, the liquid is highly elastic and tends to draw itself out of the sewer arm.

Table IV compares a formulation of the present invention (Formulation example 2) with a commercially available liquid foaming drain cleaner in respect to foam loss through the sewer arm. After 1000 sec (16.6 min) 1050 ml of foam from the commercial product has escaped through the sever arm, thus reducing the formulation's ability to deliver active to the clog site. By contrast, the formulation of the present invention has lost only 100 ml of foam in the same time period. Thus, only 5% of generated foam is lost through the sewer arm, resulting in a 95% contact rate for foam at the affected areas of the drain. A preferred contact rate for the compositions of the present invention is at least 75% of foam remaining in the affected portions of the drain, more preferred is 85% and most preferred is 95%. In both examples, approximately 2 L of foam is initially generated. A further experiment measured active hypochlorite in the vertical pipe of a sink after 10, 30 and 60 minutes following dispensing of the product into the sink. The same commercially-available foaming product was dispensed (according to label instructions) and samples were extracted at the noted time intervals. Percent hypochlorite was measured by titration. After 10 minutes, the commercial product had 27.5% of available hypochlorite (i.e. in excess of the required for foam-generation), but this dropped to zero after 30 minutes, and zero again after 60 minutes. The formulation of the present invention yielded 21% of available hypochlorite, after 10 minutes, and maintained 21% after 30 and 60 minute intervals. The present invention thus exhibits essentially no loss of active between ten and thirty minutes, and again between ten and sixty minutes after generation. An active loss rate is therefore less than about 25%, preferred is less than about 15%, more preferred is less than about 10% and most preferred is less than about 5% between intervals.

TABLE IV

| Control | | Present Invention | |
|---|---|---|---|
| Foam | Time (sec) | Foam | Time (sec) |
| 0 | 0 | 0 | 0 |
| 300 | 16 | 100 | 18 |
| 550 | 30 | * | * |
| 700 | 53 | * | * |
| 800 | 72 | * | * |
| 900 | 91 | * | * |
| 1000 | 118 | * | * |
| 1050 | 158 | * | * |
| 1050 | 180 | * | * |
| 1050 | 300 | 100 | 300 |
| 1050 | 600 | 100 | 600 |
| 1050 | 900 | 100 | 900 |
| 1050 | 1000 | 100 | 1000 |

* data not collected

A third embodiment of the present invention comprises a drain opening formulation and method of use. The formulation includes a first liquid comprising:

(i) a hypohalite (ii) a corrosion inhibitor;

(iii) a buffer;

(iv) a pH adjusting agent, and (v) a thickener and a second liquid comprising:

(i) a peroxide;

(ii) a pH adjusting agent; and (iii) a densifying agent;

and wherein the first and second liquids are separately maintained, for example, in separate chambers of a dual chambered bottle, and admix upon, concurrently with or shortly after dispensing into a drain. A most preferred method of opening drains involves pouring a first and a second liquid, simultaneously from a dual chamber bottle, into a drain to be cleaned, and allowing a period of time for the active-entrained foam to decompose the obstruction.

A preferred example of a drain cleaning formulation includes a first aqueous composition comprising:

(i) a $C_{14-18}$ alkyl betaine or sulfobetaine;

(ii) an anionic organic counterion;

(iii) an alkali metal hydroxide;

(iv) an alkali metal silicate;

(v) an alkali metal carbonate; and (vi) an alkali metal hypochlorite and a second aqueous composition comprising (a) hydrogen peroxide; and (b) sodium chloride.

Components (i) and (ii) comprise the viscoelastic thickener and are as described previously. The alkali metal hydroxide is preferably potassium or sodium hydroxide, and is present in an amount of between about 0.5 and 20% percent. The preferred alkali metal silicate is one having the formula $M_2O(SiO)_n$ where M is an alkali metal and n is between 1 and 4. Preferably M is sodium and n is 3.2. The alkali metal silicate is present in an amount of about 0 to 5 percent. The preferred alkali metal carbonate is sodium carbonate, at levels of between about 0 and 5 percent. About 1 to 15 percent hypochlorite is present, preferably about 4 to 8.0 percent.

Generally, the preferred betaine for use with hypochlorite is an alkyl dimethyl betaine or sulfobetaine compound having a 12 to 18 carbon alkyl group, and most preferably the betaine is CEDB. The alkylamido betaines and alkylamino betaines are not preferred in the presence of hypochlorite. Substituted benzene sulfonic acids are preferred as the counterion with xylene sulfonic acid being most preferred.

FORMULATION EXAMPLES

Formulation Example 1

| Liquid 1 - Oxidant | Weight Percent | Liquid 2 - Gas Generator | Weight Percent |
|---|---|---|---|
| Sodium hypochlorite | 1–10 | Hydrogen peroxide | 0.1–10 |
| Sodium hydroxide | 0.5–10 | Sodium chloride | 0–25 |
| Sodium carbonate | 0–5 | Sulfuric acid | 0.001–5 |
| Sodium silicate | 0–5 | Water | Balance |
| Surfactant | 0.1–20 | | |
| Water | Balance | | |

Formulation Example 2

| Liquid 1 - Oxidant | Weight Percent | Liquid 2 - Gas Generator | Weight Percent |
|---|---|---|---|
| Sodium hypochlorite | 5.8 | Hydrogen peroxide | 0.68 |
| Sodium hydroxide | 1.8 | Sodium chloride | 7.0 |
| Sodium carbonate | 0.06 | Water | Balance |
| Sodium silicate | 0.1 | | |
| Surfactant | 1.2 | | |
| Water | Balance | | |

Experimental

Table V below shows the hypochlorite chemical stability at a storage temperature of 21 degrees C. The numbers reported are percentage active remaining. Formulation 2 was used to obtain the data for Table V. Addtitionally, the formulation was phase stable after storage for 40 weeks at both 1.7 and 38 degrees C.

It has been found that at the unique total amount of surfactant present, especially betaine and SXS, and the ratio of betaine to counterion, the phase and the viscosity stability of the formulation is optimized, yielding a commercially stable product. It is thought that this stability is due to the optimized ratio of surfactant and counterion described herein.

TABLE V

| Percent Active Remaining | |
|---|---|
| Time (weeks) | % NaOCl |
| 0 | 100 |
| 1 | 99.96 |
| 2 | 97.59 |
| 4 | 91.55 |
| 6 | 89.66 |
| 8 | 89.14 |
| 12 | 79.14 |

TABLE V-continued

| Percent Active Remaining | |
|---|---|
| Time (weeks) | % NaOCl |
| 16 | 74.48 |
| 21 | 73.10 |
| 25 | 67.24 |

Table VI demonstrates the performance benefits of the present invention.

TABLE VI

| | Hair Amount (g) | | % Hair | Flowrate (gal/min) | |
|---|---|---|---|---|---|
| Product | Before | After | Dissolution | Initial | Final |
| Invention | 2.00 | 0.35 | 82.50 | 1.65 | 3.9 |
| Invention | 1.98 | 0.38 | 80.81 | 1.95 | 4.35 |
| Invention | 2.01 | 0.39 | 80.60 | 2.20 | 3.95 |
| Invention | 2.02 | 0.54 | 85.64 | 1.65 | 4.10 |
| | | Average | 82.39 | 1.86 | 4.08 |
| Product A | 2.01 | 0.85 | 57.71 | 1.75 | 4.30 |
| Product A | 2.03 | 1.05 | 48.28 | 2.00 | 3.70 |
| Product A | 2.02 | 0.82 | 59.41 | 1.90 | 4.25 |
| Product A | 2.00 | 1.15 | 42.50 | 1.75 | 4.25 |
| | | Average | 51.97 | 1.85 | 4.13 |
| Product B | 2.02 | 1.94 | 3.96 | 2.00 | 1.95 |
| Product B | 2.02 | 1.95 | 3.47 | 1.65 | 1.85 |
| Product B | 2.00 | 1.95 | 2.50 | — | — |
| Product B | 2.02 | 1.97 | 2.48 | 2.15 | 1.95 |
| | | Average | 3.10 | 1.93 | 1.92 |

Table VI above shows performance of the present invention on hair restrictions in drains. For this test, 2 grams of human hair was suspended in the drain at the approximate location of the stopper rod mechanism. The time for 2 liters of water to drain from the sink was recorded as the initial flowrate. A non-thickened, dry and a thickened liquid commercially available foam clog removers were used in the tests according to label instructions. Tests were also conducted with compositions of the present invention. About 500 ml of each of the drain opening compositions was poured into the drain. The time for 2 liters of water to drain from the sink was again measured and recorded as the final flowrate. After the completion of each test the remaining hair was rinsed, dried overnight at 25□C, and weighed. The present invention dissolved an average of 82.4% of the hair while the non-thickened and thickened commercial products dissolved an average of only 3.1% and 52%, respectively. Examples 1–4 which are formulation of the present invention, show a much greater average hair dissolved than any of the other examples. This improvement is thought to be due to the increased contact time afforded by the present invention. Flow rate improvement was even more dramatic, with formulation a restoring to approximately 100% of the initial flow, compared to essentially none for Product B. It has been found that once a certain amount of hair has been dissolved, the remaining hair has insufficient volume to clog the drain and will simply be rinsed away, thus restoring the drain to 100%. Thus all remaining hair after the treatment by the composition of the present invention was flushed completely out of the drain. By contrast, hair remaining after treatment with Product B was found entirely in and about the stopper. Treatment with Product A resulted in most of the hair rinsed away, but some hair was found around the stopper.

Other foam properties of interest include foam density and stability. A dense, stable foam will allow longer contact time between cleaning actives and organic clog materials. Foam stability is defined as the foam's resistance to a force tending to collapse or displace the foam. For the present invention, foam stability is determined by measuring the rate of travel of a standard object through a column of foam. The object used in this experiment is a black, phenolic screw cap found on typical laboratory sample jars. The cap has a 5 cm diameter, a 1.2 cm lip, and weighs 11 grams. The inverted cap is placed on top of the column of foam and the time to completely travel through the foam is measured. A foam displacement rate is calculated by dividing the height of the foam column by the total time required to travel through it. A preferred foam displacement rate is less than about 10 cm/min; more preferred is less than about 7 cm/min. The ratio of foam displacement rate to density can also be determined for combinations of thickened gas generating and oxidizing agents. A preferred ratio is about 50:1 to 1:1, more preferred is about 30:1 to 10:1.

Table VII shows viscosity stability of the present invention. Viscosity was measured as described above, at the times indicated and after storage at room temperature (21 degrees C.). The Table shows that the formulations of the present invention are stable over time, and do not exhibit any marked fluctuations during storage. After a short period of viscosity development, the viscosity value remains within about 8% of the initial viscosity.

TABLE VII

| Viscosity Stability | |
|---|---|
| VISCOSITY Time (days) | Viscosity-cp |
| 1 | 744 |
| 2 | 880 |
| 3 | 936 |
| 4 | 936 |
| 7 | 1032 |
| 8 | 984 |
| 14 | 1000 |
| 17 | 1008 |
| 18 | 1008 |
| 21 | 1024 |
| 28 | 1056 |
| 35 | 1056 |
| 42 | 1064 |
| 56 | 1072 |
| 84 | 1072 |
| 112 | 1048 |
| 147 | 1000 |
| 175 | 952 |

A most preferred method of opening drains involves pouring a first and a second liquid, as illustrated by Formulation Example 1, simultaneously from a dual chamber bottle. A most preferred dual chamber bottle comprises one having side-by-side, equal capacity chambers and a single dispensing orifice.

A preferred bottle orientation during pouring results in both liquids exiting the dual chambered container such that optimum foam generation occurs in the drain pipe.

While described in terms of the presently preferred embodiment, it is to be understood that such disclosure is not to be interpreted as limiting. Various modifications and alterations will no doubt occur to one skilled in the art after having read the above disclosure. Accordingly, it is intended that the appended claims be interpreted as covering all such modifications and alterations as fall within the true spirit and scope of the invention.

What is claimed is:

1. An in-situ foaming drain cleaner, comprising:

a first aqueous liquid, having a viscosity of at least about 150 cP, said first liquid comprising an oxidant, wherein the oxidant is a hypochlorite present in the first aqueous liquid in an amount of about 1–10 percent by weight based on a weight of the first aqueous liquid;

a second aqueous liquid, having a viscosity of between about 0 and 20 cP the second liquid comprising a gas-generating agent, wherein the gas-generating agent is a peroxide present in the second aqueous liquid in an amount of about 0.1 to 15 percent by weight based on a weight of the second aqueous liquid;

a hydroxide pH-adjusting agent mixed with at least one of the aqueous liquids, wherein the hydroxide is present in an amount of between about 0.5 and 10 percent by weight based on a weight of the first aqueous liquid;

a surfactant mixed with at least one of the aqueous liquids; and sodium chloride present in an amount less than about 25 percent by weight based on a weight of the second aqueous liquid;

wherein the first and second aqueous liquids are separately maintained prior to forming an admixture during delivery to a drain to be treated, whereupon the admixture generates a foam of sufficient stability for cleaning efficacy;

wherein an initial phase of foam is generated at a rate of between about 150 and 800 ml/sec, the initial phase lasting about 10 seconds;

wherein a second phase of foam is generated at a rate between about 0 and 150 ml/sec;

wherein said foam is characterized by a density of at least about 0.1 g/ml;

wherein said foam is characterized by a foam to liquid ratio of greater than about 3:1;

wherein said foam is characterized by a half life of greater than about thirty minutes;

wherein the oxidant is present in a molar excess over the gas generating agent in a range of about 6:1 to 2:1.

2. An in-situ foaming drain cleaner as recited in claim 1, wherein the oxidant is sodium hypochlorite.

3. An in-situ foaming drain cleaner as recited in claim 1, wherein the hydroxide is sodium hydroxide.

4. An in-situ foaming drain cleaner as recited in claim 1, wherein the surfactant is an amine oxide.

5. An in-situ foaming drain cleaner as recited in claim 1, wherein a rate of foam generation during a time period from about 15–30 seconds from when the first and second aqueous liquids are mixed is about 3–40 ml/sec.

6. An in-situ foaming drain cleaner, comprising:

a first aqueous liquid, having a viscosity of at least about 150 cP, said first liquid comprising an oxidant in an amount of about 1–10 percent by weight based on the weight of the first aqueous liquid;

a second aqueous liquid, having a viscosity of between about 0 and 20 cP the second liquid comprising a gas-generating agent in an amount of about 0.1 to 15 percent by weight based on the weight of the second aqueous liquid;

a hydroxide pH-adjusting agent mixed with at least one of the aqueous liquids wherein the hydroxide is present in an amount of between about 0.5 and 10 percent by weight based on the weight of the first aqueous liquid; and a surfactant mixed with at least one of the aqueous liquids;

wherein the first and second aqueous liquids are separately maintained prior to forming an admixture during delivery to a drain to be treated, whereupon the admixture generates a foam of sufficient stability for cleaning efficacy;

wherein an initial phase of foam is generated at a rate of between about 150 and 800 ml/sec;

wherein a second phase of foam is generated at a rate between about 0 and 150 ml/sec;

wherein said foam is characterized by a density of at least about 0.1 g/ml;

wherein said foam is characterized by a foam to liquid ratio of greater than about 3:1;

wherein said foam is characterized by a half life of greater than about thirty minutes;

wherein the oxidant is present in a molar excess over the gas generating agent in a range of about 6:1 to 2:1.

7. An in-situ foaming drain cleaner as recited in claim 6, wherein the oxidant is a hypochlorite.

8. An in-situ foaming drain cleaner as recited in claim 7, wherein the oxidant is sodium hypochlorite.

9. An in-situ foaming drain cleaner as recited in claim 6, wherein the gas-generating agent is a peroxide.

10. An in-situ foaming drain cleaner as recited in claim 6, wherein the hydroxide is sodium hydroxide.

11. An in-situ foaming drain cleaner as recited in claim 6, wherein the surfactant is an amine oxide.

12. An in-situ foaming drain cleaner as recited in claim 6, further comprising sodium chloride present in an amount less than about 25 percent by weight based on a weight of the second aqueous liquid.

13. An in-situ foaming drain cleaner as recited in claim 6, wherein said initial phase lasts about 10 seconds.

14. An in-situ foaming drain cleaner as recited in claim 6, wherein a rate of foam generation during a time period from about 15–30 seconds from when the first and second aqueous liquids are mixed is about 3–40 ml/sec.

* * * * *